US005809468A

United States Patent [19]

Takahashi et al.

[11] Patent Number: 5,809,468

[45] Date of Patent: Sep. 15, 1998

[54] VOICE RECORDING AND REPRODUCING APPARATUS HAVING FUNCTION FOR INITIALIZING CONTENTS OF ADAPTIVE CODE BOOK

[75] Inventors: Hidetaka Takahashi, Musashino; Hideo Okano, Han-no, both of Japan

[73] Assignee: Olympus Optical Co., Ltd., Tokyo, Japan

[21] Appl. No.: 544,461

[22] Filed: Oct. 18, 1995

[30] Foreign Application Priority Data

Oct. 21, 1994 [JP] Japan ..... 6-256768
Oct. 17, 1995 [JP] Japan ..... 7-268303

[51] Int. Cl.[6] ..... G10L 9/14

[52] U.S. Cl. ..... 704/269; 704/262; 704/278

[58] Field of Search ..... 395/2.87, 2.78, 395/2.28, 2.71, 2.75, 2.1, 2.27, 2.23; 704/278, 269, 219, 262, 266, 200, 201, 224

[56] References Cited

U.S. PATENT DOCUMENTS 4,717,261 1/1988 Kita et al. ..... 368/63
5,014,317 5/1991 Kita et al. ..... 395/2.6
5,218,640 6/1993 Morio et al. ..... 395/2.1
5,265,190 11/1993 Yip et al. ..... 395/2.31
5,410,526 4/1995 Maeda et al. ..... 369/48

FOREIGN PATENT DOCUMENTS 63-259700 10/1988 Japan ..... G10L 9/18

*Primary Examiner*—Richemond Dorvil
*Attorney, Agent, or Firm*—Frishauf, Holtz, Goodman, Langer & Chick

[57] ABSTRACT

A voice recording/reproducing apparatus comprises a coding parameter extracting section for extracting a coding parameter by use of either past voice data or past parameter. A coding section codes voice data by use of the coding parameter extracted by the coding parameter extracting section. A predicting section predicts a decoding signal by use of either past decoded voice data corresponding to coded voice data from the voice coding means or the past parameter. A voice decoding section decodes the voice data by use of the predicted decoding signal. A voice synthesizing section outputs voice data synthesized based on an output signal from the predicting section and an output signal from the voice decoding section. An initializing section initializes at least one of either a content of the predicting section or a content of the voice synthesizing section in accordance with a reproducing position of recorded voice data.

11 Claims, 9 Drawing Sheets

VOICE RECORDING AND REPRODUCING APPARATUS HAVING FUNCTION FOR INITIALIZING CONTENTS OF ADAPTIVE CODE BOOK

BACKGROUND OF THE INVENTION

1. Field of the Invention

The present invention relates to a voice recording/reproducing apparatus.

2. Description of the Related Art

In recent years, there has been known a voice recording/reproducing apparatus, the so-called digital recorder, in which a voice signal obtained from a microphone is converted to a digital signal, and recorded to, for example, a semiconductor memory, and the voice signal is read from the semiconductor to be converted to an analog signal and outputted from a speaker as a voice at the time of reproducing. Such a recording/reproducing apparatus is disclosed in Japanese Patent Application KOKAI Publication No. 63-259700.

Generally, in the voice recording/reproducing apparatus, in order to save an amount of data recorded in the semiconductor memory, the amount of data to be generated is controlled to be as small as possible by efficiently coding the digitized voice signal. There has been widely used a code drive linear predictive coding system having an adaptive code book as a means for efficient coding. According to the code drive linear predictive coding system, there has been known that a relatively high quality reproduced voice can be obtained when a bit rate of about 4 Kb/s to 16 Kb/s is used.

In the above-mentioned voice recording/reproducing apparatus, a reproduction position where recorded voice data is reproduced is determined by an address designation to a voice memory. A change of the reproduction position to an arbitrary address position in the case of a forward feeding, a rewinding, or a repeating is performed by a count operation of an address counter.

However, the above-mentioned adaptive code book is prepared by a past voice source signal. Therefore, when the reproduction position is changed, the adaptive code book will have a content which has no relation to the previous content. Particularly, when the reproduction position designated by an operator is a stationary section of a vocal voice, a pulse signal having a vocal voice cannot be generated. Therefore, there has been a problem in that the quality of the reproduced voice is deteriorated.

Moreover, in a case where a user once stops recording and performs the recording again, or performs an edit operation such as an insert recording, cutting the voice partially, the contents of voice data recorded in the adaptive code book have no relation to each other before and after the above recording stop operation or the edit operation is performed. Due to this, in continuously reproducing the recorded contents, an undesired voice is generated before and after the recording stop operation or the edit operation is performed. For this reason also, there has been a problem in that the quality of the reproduced voice is deteriorated.

SUMMARY OF THE INVENTION

A first object of the present invention is to provide a voice recording/reproducing apparatus which can obtain a reproduced voice having good quality even if a reproduction position is changed.

A second object of the present invention is to provide a voice recording/reproducing apparatus which can obtain a reproduced voice having good quality even if a record stopping or an edit operation is performed at the time of recording a voice.

In order to attain the first object, there is provided a voice recording/reproducing apparatus comprising: coding parameter extracting means for extracting a coding parameter by use of either past voice data or past parameter; voice coding means for coding voice data by use of the coding parameter extracted by the coding parameter extracting means; predicting means for predicting a decoding signal by use of either past decoded voice data corresponding to coded voice data from the voice coding means or the past parameter; voice decoding means for decoding the voice data by use of the decoding signal predicted by the predicting means; voice synthesizing means for outputting voice data synthesized based on an output signal from the predicting means and an output signal from the voice decoding means; and initializing means for initializing at least one of either a content of the predicting means or a content of the voice synthesizing means in accordance with a reproducing position of recorded voice data.

Also, in order to attain the first object, there is provided a voice reproducing apparatus comprising: predicting means for predicting a decoding signal by use of either past decoded voice data or a past parameter; voice decoding means for decoding voice data by use of the decoding signal predicted by the predicting means; voice synthesizing means for outputting voice data synthesized based on an output signal from the predicting means and an output signal from the voice decoding means; and initializing means for initializing at least one of either a content of the predicting means or a content of the voice synthesizing means in accordance with a reproducing position of recorded voice data.

Moreover, in order to attain the first object, there is provided a voice recording/reproducing apparatus comprising: coding parameter extracting means for extracting a coding parameter by use of either past voice data or past parameter; voice coding means for coding voice data by use of the coding parameter extracted by the coding parameter extracting means; predicting means for predicting a decoding signal by use of either past decoded voice data corresponding to coded voice data from the voice coding means or the past parameter; voice decoding means for decoding the voice data by use of the decoding signal predicted by the predicting means; and controlling means for controlling to start the voice decoding by the voice decoding means from a reproducing position being returned by a predetermined time than a designated reproducing position in accordance with a reproducing position of recorded voice data.

Furthermore, in order to attain the first object, there is provided a voice reproducing apparatus comprising: predicting means for predicting a decoding signal by use of either past decoded voice data or past parameter; voice decoding means for decoding voice data by use of the decoding signal predicted by the predicting means; and controlling means for controlling to start the voice decoding by the voice decoding means from a reproducing position being returned by a predetermined time than a designated reproducing position in accordance with a reproducing position of recorded voice data.

In order to attain the second object, there is provided a voice recording/reproducing apparatus comprising: coding parameter extracting means for extracting a coding parameter by use of either past voice data or past parameter; voice coding means for coding voice data by use of the coding parameter extracted by the coding parameter extracting means; recording means for recording data showing that at least a voice recording is stopped or an editing operation is executed; predicting means for predicting a decoding signal by use of either past decoded voice data corresponding to coded voice data from the voice coding means or the past parameter; and initializing means for initializing a content of the predicting means when data showing that the voice recording is stopped or the editing operation is executed is detected at the time of reproducing.

Also, in order to attain the second object, there is provided a voice reproducing apparatus comprising: predicting means for predicting a decoding signal by use of either past decoded voice data or past parameter; voice decoding means for decoding voice data by use of the decoding signal predicted by the predicting means; and initializing means for initializing a content of the predicting means based on data showing that at least a voice recording is stopped or an editing operation is executed.

Moreover, in order to attain the second object, there is provided a voice recording/reproducing apparatus comprising: coding parameter extracting means for extracting a coding parameter by use of a first adaptive code book where past voice source data is recorded; voice coding means for coding voice data by use of the coding parameter extracted by the coding parameter extracting means; recording means for recording data showing that at least a voice recording is stopped or an editing operation is executed; predicting means for predicting a decoding signal by use of past decoded voice source data recorded in a second adaptive code book corresponding to coded voice data from the voice coding means; voice decoding means for decoding the voice data by use of the decoding signal predicted by the predicting means; and initializing means for initializing a content of the predicting means when data showing that the voice recording is stopped or the editing operation is executed is detected at the time of reproducing.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The following will explain the embodiments of the present invention with reference to the drawings.

Figure 1:
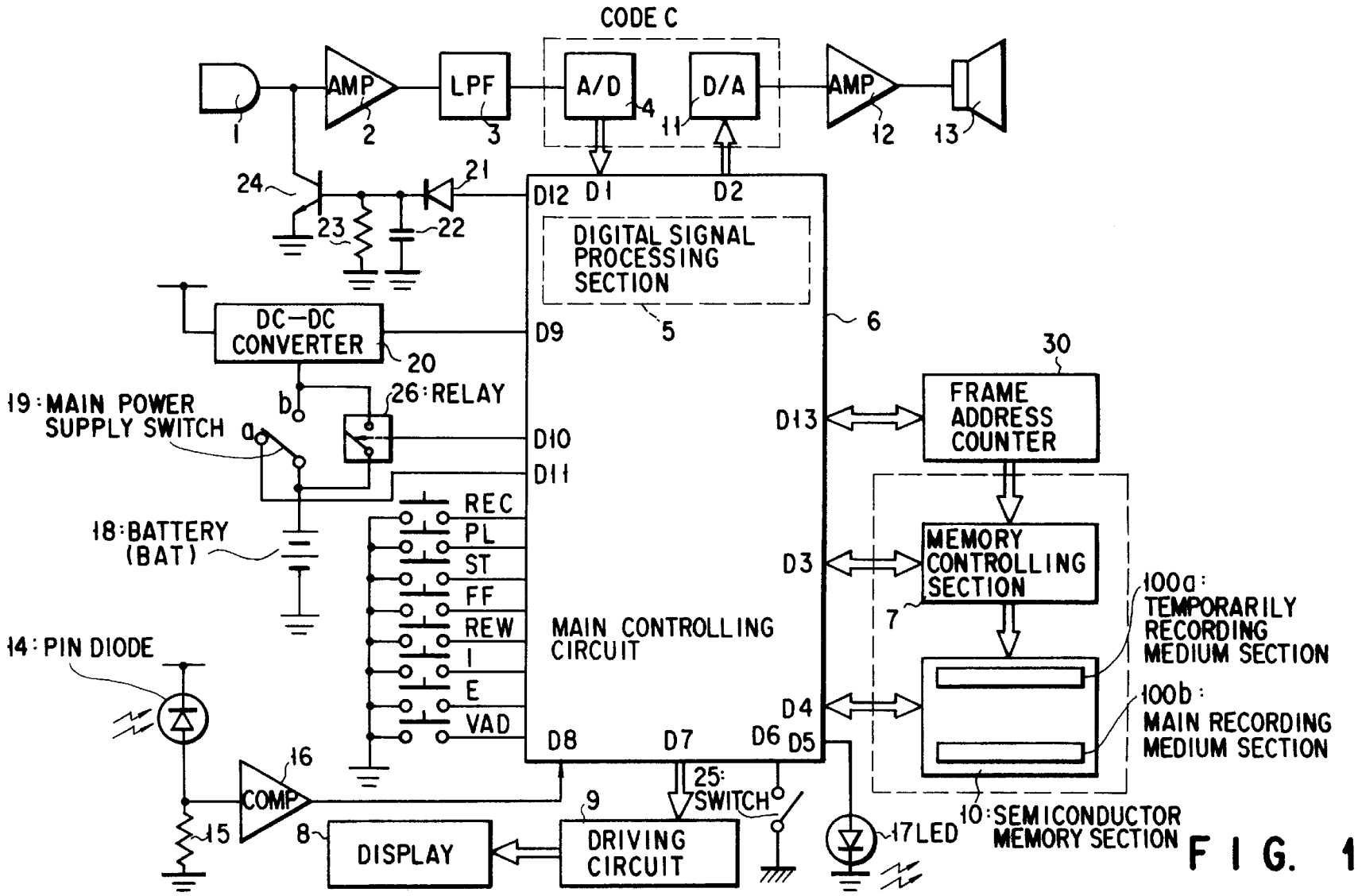
FIG. 1 is a view showing the structure of a voice recording/reproducing apparatus to which the present invention is applied.

FIG. 1 is a view showing the structure of a voice recording/reproducing apparatus to which the present invention is applied.

In FIG. 1, a microphone 1 is connected to a terminal D1 of a main controlling circuit 6 with a built-in digital signal processing section (hereinafter called DSP) 5 through an amplifier (AMP) 2, a low pass filter (LPF), and an analog/digital (A/D) converter 4. The main controlling circuit 6 comprises compressing and expanding means for compressing and expanding voice, checking means for checking whether an input signal is a voiced voice or an unvoiced voice, time axis compressing means, detecting (predicting) means for detecting or predicting a level of the input signal, conditional time axis compressing means, detecting means for detecting a signal inputted at high speed, and data processing means. A speaker 13 is connected to a terminal D2 of the main controlling circuit 6 through an amplifier (AMP) 12 and a digital/analog (D/A) converter 11. In this case, the A/D converter 4 and the D/A converter 11 constitute a CODEC.

A terminal D3 of the main controlling circuit 6 is connected to a memory controlling circuit 7, and a terminal D is connected to a semiconductor memory section 10, which is detachable from the voice recording/reproducing apparatus.

A terminal D5 of the main controlling circuit 6 is connected to a light emitting diode (LED) 17. The LED 17 transmits data recorded into the semiconductor memory section 10, and outputting an output signal showing that data sent from an outer unit is receivable. The LED 17 can be also used as a display device, which emits light when the voice is inputted or output at the recording time or the reproducing time. In this case, as LED 17, there is used an infrared LED including visible light components, for example, peak wavelength of 500 nm to 1000 nm, preferably a relative low wavelength of 600 nm to 900 nm.

A terminal D6 of the main controlling circuit 6 is connected to a switch 25, and a terminal D7 is connected to a display device 8 through a driving circuit 9.

A terminal D8 of the main controlling circuit 6 is connected to a connecting point between a PIN diode 14 and a resistor 15 through a voltage comparator (COMP) 16. In this case, PIN diode 14, resistor 15, and voltage comparator 16 constitute data receiving means or means for receiving a data transfer starting signal.

A terminal D9 of the main controlling circuit 6 is connected to a DC—DC converter 20. The DC—DC converter 20 is connected to a battery (BAT) 18 through a parallel connection circuit formed of a main power supply switch 19, which is switchable between a contact a and a contact b, and a relay 26. A terminal 10 of the main controlling circuit 6 is connected to the relay 26, and a terminal 11 is connected to the contact a of the main power supply switch 19.

The DC—DC converter 20 outputs a voltage boosted from the battery 18 to supply a stable power supply voltage to each means. Also, the DC—DC converter 20 supplies a signal, which shows whether or not the voltage of the battery 18 is below a fixed value, to the terminal D9. Thereby, the main control circuit 6 can detect the consumption state of the battery 18. The main power supply switch 19 and the relay 26 are connected in parallel such that power is not immediately stopped even if the main power supply switch 19 is turned off. Also, the state that the main power supply switch 19 is turned off can be checked by detecting the voltage of the battery 18 when the main power supply switch 19 is switched to the contact a.

A terminal D12 of the main control circuit 6 is connected to a transistor 24, a resistor 23, and a capacitor 22 through a diode 21. The transistor 24 is connected to a connecting point between the microphone 1 and the amplifier 2. A terminal 13 of the main controlling circuit 6 is connected to the memory controlling circuit 7 through a frame address counter 30. The frame address counter 30 performs a count operation based on frame address data sent from the main controlling circuit 6 so as to designate a frame address to the memory controlling circuit 7.

Moreover, operational buttons, such as a recording button (REC), a play button (PL), a stop button (ST), a forward feeding button (FF), a rewinding button (REW), an I (instruction) mark button I, an E mark (END) button E, and a voice active detector button VAD are connected to the main controlling circuit 6.

Moreover, as shown in FIG. 1, the semiconductor memory 10 comprises a temporarily recording medium section 100*a*, and a main recording medium section 100*b*. As main recording medium section 100*b*, there can be used a flash memory, an optical magnetic disk, a magnetic disk, or a magnetic tape. As temporarily recording medium section 100*a*, there can be used a device, which can perform a high speed reading as compared with the main recording medium section 100*b*, such as an SRAM, a DRAM, an EEPROM, a high dielectric memory, or a flash memory. In this embodiment, the SRAM is used as temporarily recording section 100*a* and the flash memory is used as main recording medium section 100*b*.

Figure 2:
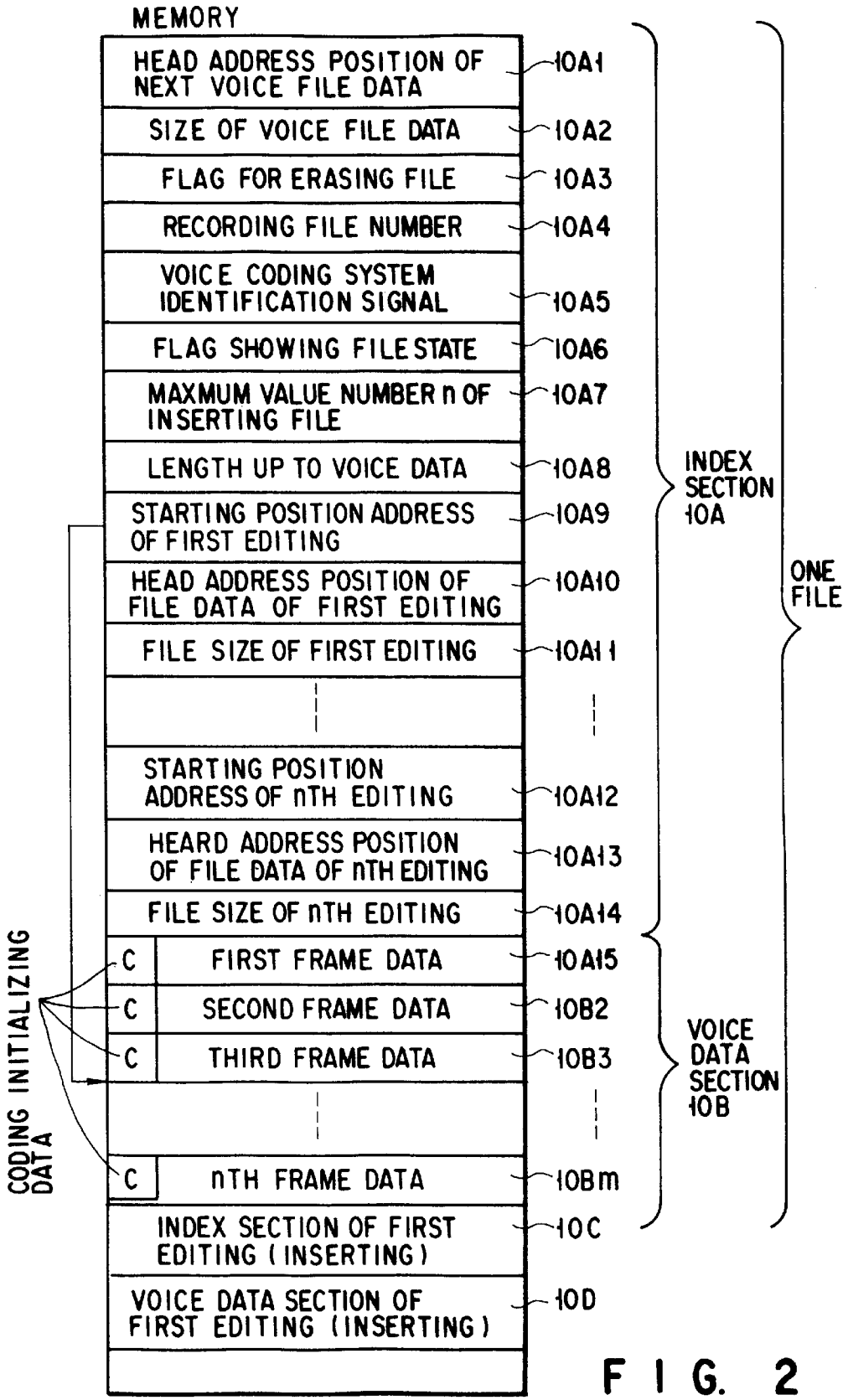
FIG. 2 is a view showing the recording structure of a semiconductor memory section of FIG. 1.

FIG. 2 is a view showing the recording structure of the semiconductor memory section 10. More specifically, a memory space is divided into an index section 10A and a voice data section 10B. In the index section 10A, there are recorded a head address position data 10A1 of next voice file data, size data 10A2 of voice file data, flag data for file erasing 10A3, a recording file number 10A4, identification data 10A5 of a voice coding system, flag data 10A6 showing a file state, a maximum number (n) of files, which can be edited (inserted) 10A7, and length data 10A8 up to inserted voice data. In addition, starting position address data at the time of editing, head address position data of file data, and file size data are recorded to the index section 10A, starting from starting position address data 10A9 of the first editing, head address position data 10A10 of file data of the first editing, file size data 10A11 of the first editing to starting position address data 10A12 of the maximum inserting nth editing, head address position data 10A13 of file data of the maximum inserting nth editing, file size data 10A14 of the maximum inserting nth editing.

In the voice data section 10B, there are recorded voice coding data including first frame data 10B1, second frame data 10B2, . . . mth frame data 10Bm. In this embodiment, coding initializing data C showing whether or not the content of adaptive book to be described later is initialized is recorded every frame 10B1, 10B2, . . . 10Bm of the voice coding data 10B. The recording position of the coding initializing data C is allocated to the most significant bit of the first byte of each frame data or the least significant bit. Or, the recording position of the coding initializing data C is allocated to the most significant bit of the final byte of each frame data or the least significant bit. According to this embodiment, the recording position of the coding initializing data C is allocated to the fourth bit of the first byte of each frame data.

In the above-mentioned semiconductor memory section 10 of this embodiment, data showing the recording position of voice data is recorded in the detachable semiconductor memory section 10. However, the data may be recorded to a semiconductor memory (not shown) (interior of the main controlling section 6) provided in the memory controlling circuit 7 of the recording/reproducing apparatus.

The following will explain the above-mentioned I mark and the E mark.

Since a plurality of documents are recorded to the recording media, an operator operates an I mark button at the time of recording, thereby recording an index mark, which is called as an instruction (I) mark, together with the document to show the relationship in priority among the documents recorded to the recording medium. As a result, a typist or a secretary, who types the recorded document, can easily know the relationship in priority by the voice with reference to the I mark. Also, the operator operates an E mark button, thereby informing the typist of the separation of the plurality of sentences.

Figure 3:
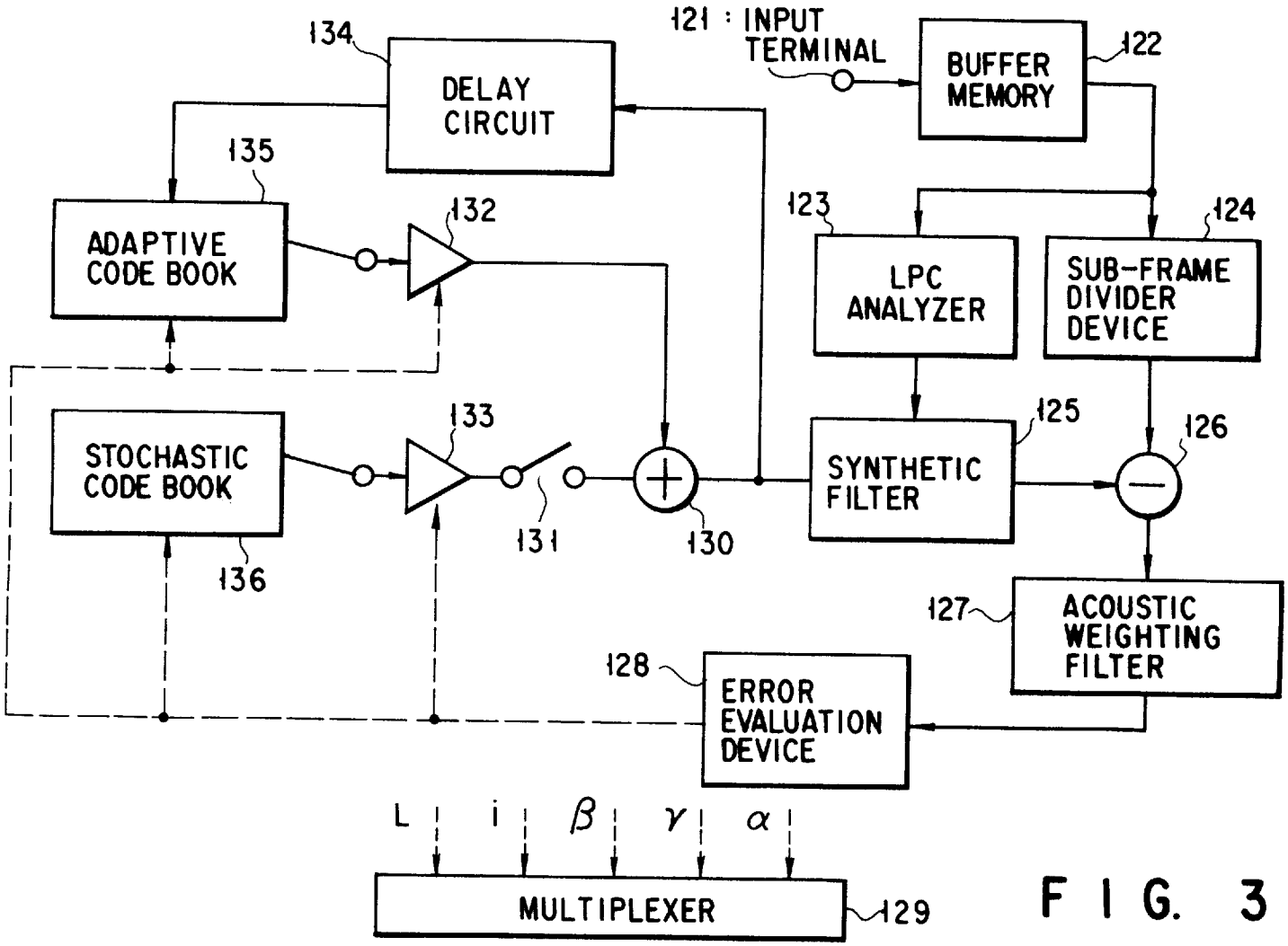
FIG. 3 is a view showing the structure of a coding section of DSP.
Figure 4:
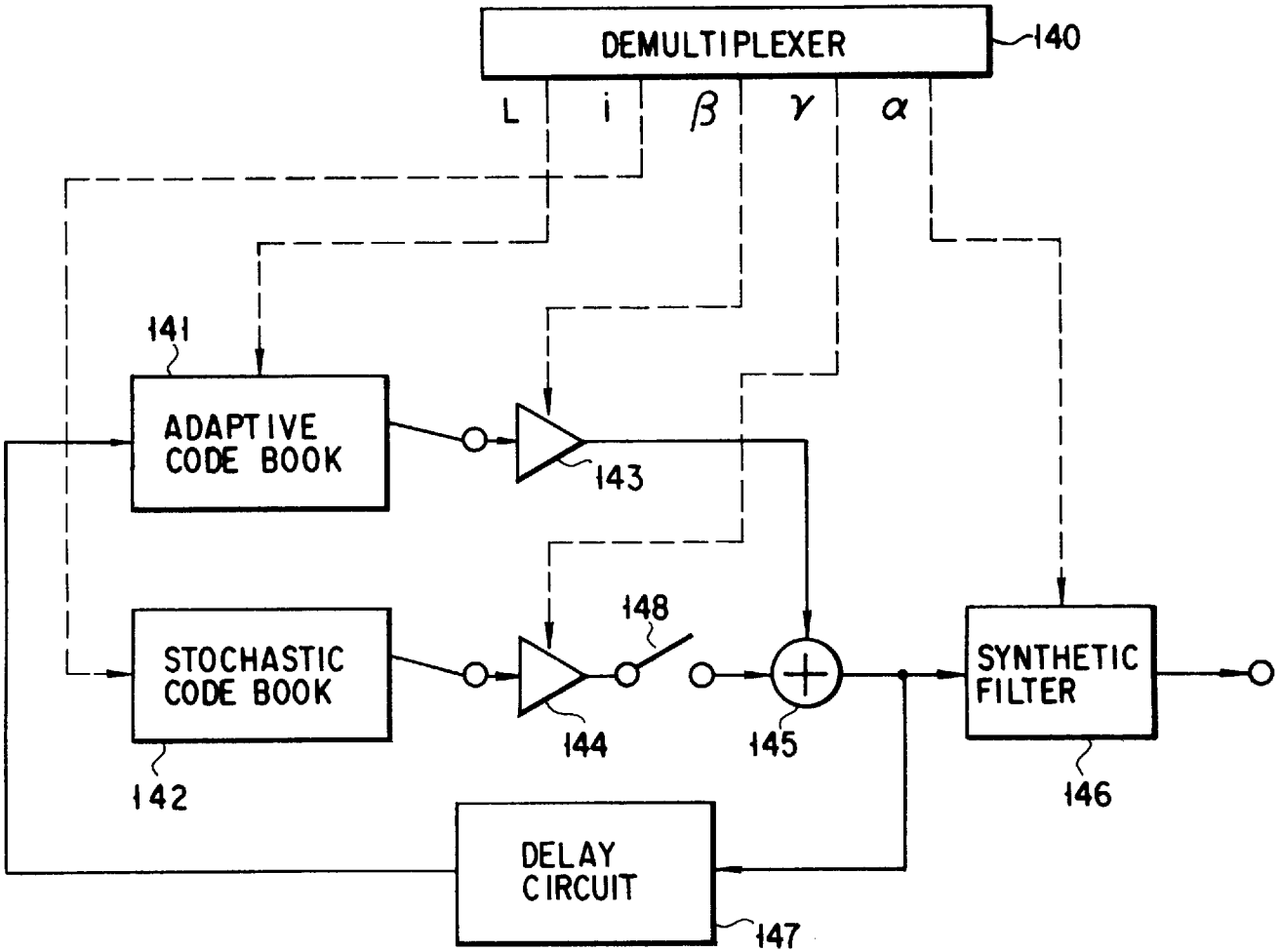
FIG. 4 is a view showing the structure of a decoding section of DSP.

FIG. 3 is a view showing the structure of the coding section in the structure of DSP 5 of FIG. 1, and FIG. 4 is a view showing the structure of the decoding section.

FIG. 3 is a block diagram of a code-driven linear predictive coding system having an adaptive code book. In the figure, an adaptive code book 135 is connected to a first input terminal of an adder 130 through a multiplier 132. A stochastic code book 136 is connected to a second input terminal of the adder 130 through a multiplier 133 and a switch 131. An output terminal of the adder 130 is connected to a first input terminal of a subtracter 126 through a synthetic filter 125, and connected to the adaptive code book 135 through a delay circuit 134.

A buffer memory 122 connected to an input terminal 121 is connected to the synthetic filter 125 through an LPC analyzer 123, and connected to a second input terminal of the subtracter 126 through a sub-frame divider 124. An output terminal of the subtracter 126 is connected to an input terminal of an error evaluation device 128 through an acoustic weighting filter 127. An output of the error evaluation device 128 is connected to the adaptive code book 135, the adders 132, 133, and the stochastic code book 136.

Moreover, a multiplexer 129 is connected to the LPC analyzer 123 and the error evaluation device 128.

The above-mentioned coding section comprises coding parameter extracting means for extracting a coding parameter by use of the adaptive code book 135 to which past voice source data is recorded and coding means (stochastic code book 136) for coding a voice by use of the extracted coded parameter.

FIG. 4 is a view showing the structure of a decoding apparatus corresponding to the code-driven linear predictive coding apparatus of FIG. 3. In the figure, an adaptive code book 141 is connected to a first input terminal of an adder 145 through a multiplier 143. A stochastic code book 142 is connected to a second input terminal of an adder 145 through a multiplier 144 and a switch 148. An output terminal of the adder 145 is connected to a synthetic filter (voice synthesizing means) 146, and connected to the adaptive code book 141 through a delay circuit 147. Moreover, a demultiplexer 140 is connected to the adaptive code book 141, the stochastic code book 142, the multipliers 143, 144, and the synthetic filter 146.

The above-mentioned decoding section comprises predicting means (including adaptive code book 141) for predicting the decoding signal by use of past decoded voice source data which is recorded to the adaptive code book 141 and decoding means (including stochastic code book 142) for decoding the voice data by use of the predicted decoding signal.

The following will explain the operation in which the voice is recorded to the semiconductor memory section 10 after starting the recording and the voice is reproduced.

At the time of the recording, the analog voice signal obtained from the microphone 1 is amplified by AMP 2 and its frequency band is restricted through LFP 3. Thereafter, the signal is converted to the digital signal by the A/D converter 4 to be inputted to the DSP 5 of the interior of the main controlling circuit 6.

At this time, the level of the signal inputted from the microphone 1 is detected. If the detected value is larger than a rated value, for example, −6 dB, which is the maximum range of the A/D converter 4, a pulse is outputted to the diode 21 connected to a twelfth terminal of the main controlling circuit 6, and an electric charge is charged to the capacitor 22, and the voltage is applied to the transistor 24. Then, the impedance among the amplifier 2, the transistor 24, and the ground is changed, the signal to be inputted to the amplifier 2 is restricted, so that a gain is controlled. The electric charge charged to the capacitor 22 is gradually discharged through the resistor 23.

Voice data compressed by the coding processing of the DSP 5 is recorded to the semiconductor memory section 10 through the third and fourth terminals of the main controlling circuit 6.

At the time of reproducing, the main control circuit 6 reads voice data recorded in the semiconductor memory section 10 to be supplied to the DSP 5. Voice data expanded by the decoding processing of the DSP 5 is converted to the analog signal by the D/A converter 11, amplified by the amplifier 12, and outputted from the speaker 13. Also, the main controlling circuit 6 controls the driving circuit 9 to display various data such as the present operation mode onto the display 8.

The following will explain the coding processing of the DSP 5 in detail with reference to FIG. 3.

In FIG. 3, the original voice signal sampled by 8 KHz is inputted from the input terminal 121, and a voice signal of a predetermined frame distance (e.g., 20 ms, that is, 160 samples) is stored in the buffer memory 122. The buffer memory 122 transmits the original voice signal to the LPC analyzer 123 by the fame unit.

The LPC analyzer 123 LPC-analyzes the original voice signal, extracts a linear prediction parameter $\alpha$, which shows a spectrum property, to be transmitted to the synthetic filter 125 and the multiplexer 129. The sub-frame divider 124 divides the original voice signal of the frame to the predetermined sub-frame distance (e.g., 5 ms, that is, 40 samples). Thereby, the sub-frame signals of the first sub-frame to the fourth frame are prepared from the original voice signal of the frame.

A delay L of the adaptive code book 135 and a gain $\beta$ are determined by the following processing.

First, a delay, which corresponds to a pitch period, is provided to the input signal of the synthetic filter 125 of the preceding sub-frame, that is, the voice source signal as an adaptive code vector. For example, if the pitch period to be assumed is set to 40 to 167 samples, the signals of 128 kinds of 40 to 167 sample delays are prepared as adaptive code vectors, and stored in the adaptive code book 135. At this time, the switch 131 is in an open state. Therefore, the respective adaptive code vectors are multiplied by the varied gain by use of the multiplier 132. Thereafter, the respective adaptive code vectors are passed through the adder 130, and directly inputted to the synthetic filter 125. The synthetic filter 125 performs the synthesizing processing by use of the linear prediction parameter a from the LPC analyzer 123, so as to sent the synthetic vectors to the subtracter 126.

The subtracter 126 performs the subtraction between the original voice vector and the synthetic vector, and the obtained error vector is transmitted to the acoustic weighting filter 127. The acoustic weighting filter 127 provides the weighting processing to the error vector in consideration of the acoustic property. The error evaluation device 128 calculates a mean square value of the error vector to search the adaptive code vector whose mean square value is minimum, and the delay L and the gain $\beta$ are sent to the multiplexer 129. In this way, the delay L and the gain $\beta$ of the adaptive code book 135 are determined.

An index i of the stochastic code book 136 and a gain $\gamma$ are determined by the following processing.

For example, 512 kinds of stochastic signal vectors whose number of dimensions correspond to the length of the sub-frame are stored in the stochastic code book 136 in advance. An index is provided to each of the vectors. At this time, the switch 131 is in a closed state. The optimal adaptive code vector determined by the above processing is multiplied by an optimal gain $\beta$ by use of the multiplier 133, and transmitted to the adder 130.

Then, the respective stochastic code vectors are multiplied by the varied gain by use of the multiplier 133 to be inputted to the adder 130. The adder 130 performs the addition of the optimal adaptive code vector by which the optimum gain $\beta$ is multiplied and each of the stochastic code vectors. Then, the result of the addition is inputted to the synthetic filter 125.

Then, the following processing is performed in the same way as the parameter determining processing of the adaptive code book.

More specifically, the synthetic filter 125 performs the synthesizing processing by use of the linear prediction parameter $\alpha$ from the LPC analyzer 123, so as to send the synthetic vectors to the subtracter 126.

The subtracter 126 performs the subtraction between the original voice vector and the synthetic vector, and the obtained error vector is transmitted to the acoustic weighting filter 127. The acoustic weighting filter 127 provides the weighting processing to the error vector in consideration of the acoustic property. The error evaluation device 128 calculates a mean square value of the error vector to search the adaptive code vector whose mean square value is minimum, and the index i and the gain $\gamma$ are sent to the multiplexer 129. In this way, the delay i and the gain $\gamma$ of the stochastic code book 136 are determined.

The multiplexer 129 multiplexes each of the quantized linear predictive parameter $\alpha$, the delay L of the adaptive code book 135, the gain $\beta$, the index i of the stochastic code book 136, and the gain $\gamma$ to be transferred to the semiconductor memory section 10 through the memory controlling circuit 7 shown in FIG. 1.

The following will explain a decoding operation of DSP 5 with reference to FIG. 4.

In FIG. 4, the demultiplexer 140 resolves the received signal into the linear predictive parameter α, the delay L of the predictive code book 135, the gain β, the index i of the stochastic code book 136, and the gain γ. The resolved linear predictive parameter a is outputted to a synthetic filter 146, the delay L and the gain β are outputted to each of adaptive code books 141 and the multiplier 143, and the the index i, and the gain γ are outputted to each of the stochastic code books 142 and the multiplier 144.

Then, an adaptive code vector of the adaptive code book 141 is selected based on the delay L of the adaptive code book 141 outputted from the demultiplexer 140. The adaptive code book 141 has the same content as the content of the adaptive code book 135 of the coding apparatus. In other words, the past voice source signal is inputted to the adaptive code book 141 through the delay circuit 147. The multiplier 143 amplifies the inputted adaptive code vector based on the received gain β to be transmitted to the adder 145.

Then, a code vector of a stochastic code book 142 is selected based on index i of the stochastic code book 142 outputted from the demultiplexer 140. In this case, the stochastic code book 142 has the same content as the content of the stochastic code book 136 of the coding device. The multiplier 144 amplifies the inputted stochastic code vector so as to be transmitted to the adder 145 base on the received gain γ.

The adder 145 adds the amplified stochastic code vector and the amplified adaptive code vector to be transmitted to the synthetic filter 146 and the delay circuit 147. The synthetic filter 146 performs the synthesizing processing using the received linear prediction parameter a as a coefficient to output a synthesized voice signal.

The following will explain the entire operation of the main controlling circuit 6 in detail.

Figure 5:
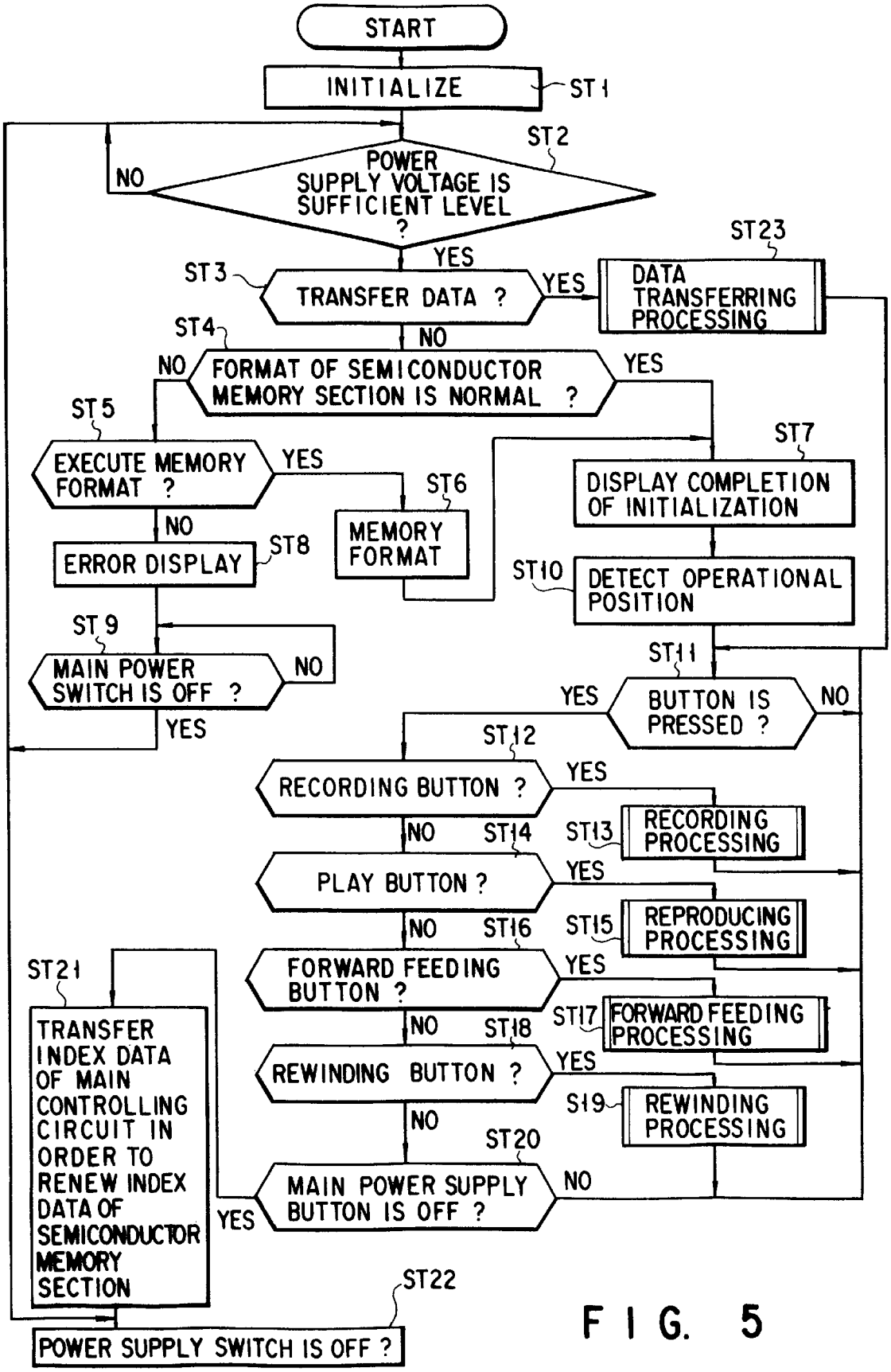
FIG. 5 is a flow chart for explaining the general operation of a main controlling circuit.

If the battery BAT is set and power is supplied, the main controlling circuit 6 starts the operation as shown in the flow chart of FIG. 5.

First of all, the initialization of the external condition of the main controlling circuit 6 or the internal memory section are performed (step ST1). At this time, a detection signal of the state of the battery 18 is inputted to the terminal D9 of the main controlling circuit from the DC—DC converter 20. The detection signal shows whether or not a power voltage of a battery 18 is higher than the rated value, for example, 1V, or whether or not the impedance of the battery 18 is higher than the rated value. After completing the initialization, the main controlling circuit 6 detects whether or not the battery 18 has usable capacity based on the detection signal, that is, whether or not the power voltage is sufficient (step ST2). As a result of the detection, if it is detected that the battery is not in a usable state, the power supply to the entire voice recording and reproducing apparatus is stopped, a switch (not shown) provided between the battery 18 and each circuit is turned off, a display showing that the capacity of the battery 18 is not sufficient is performed at the display 8 through the driving circuit 9.

In step ST2, if it is detected that the battery is in a usable state, the relay 26 is turned on. Thereafter, it is checked whether or not data transfer is performed by checking whether or not the switch 25 or the stop button ST and the foward feeding FF are simultaneously pressed (step ST3). In the case of YES, the processing goes to a data transferring processing (step ST23).

In the case of NO, data of the index section 10A of the semiconductor memory section 10, that is, operation starting position data 10A1, operation ending position data 10A2, and other code modes and operation conditions are read.

At this time, it is checked whether or not a predetermined index is normally recorded in the semiconductor memory section 10, that is, whether or not the format of the semiconductor memory 10 is normal (step ST4). If data, which is not formatted, is recorded in the semiconductor memory section 10, it is determined that the format of the semiconductor memory section 10 is not normal. In this case, using condition data is inputted to the index section 10A of the semiconductor memory section 10. And, it is checked whether or not the memory format (initialization), which is the processing for inputting "0" to the voice data section 10B, is performed (step ST5). In this case, the driving circuit 9 is controlled. Then, the display 8 performs the confirming display indicating whether or not the memory format is performed.

Here, if the button for confirming and indicating the memory format processing (this button can be substituted by the recording button REC) is pressed, the format (initialization) of the semiconductor memory section 10 is performed (step ST6). After completing the format, the driving circuit 9 is controlled, and the completion of the initialization is displayed by the display 8 (step ST7).

If the button for confirming and indicating that no memory format is performed (this button can be substituted by stop button ST) is pressed, the driving circuit 14 is controlled, and an error display, which shows that the semiconductor memory section 10 is not normal, is performed by the display 15 (step ST8). Also, the message showing that the semiconductor memory section 10 should be exchanged is displayed.

Then, a switch (not shown) provided between the battery BAT for supplying power to the entire voice recording and reproducing apparatus and each circuit is turned off. Thereafter, it is waited that the main power switch 19 is turned off to exchange the semiconductor memory section 10 (step ST9). If it is detected that the power switch 19 is turned off, the processing goes to step ST22, and the power switch is turned off.

On the other hand, if the initialization of the semiconductor memory section 10 is normally completed, the present operational position is detected based on data read from the index section 10A after the completion of initialization (step ST10). Thereafter, each circuit is set to be in a standby position as detecting which button of the apparatus is pressed (step ST11).

Then, when it is detected that either button is pressed, it is detected whether the operated button is the recording button REC or not (step ST12). If the recording button REC is pressed, DSP 5 is controlled to compress voice data inputted from the A/D converter 4, and the memory controlling circuit 7 is controlled, so that the operation goes to the recording processing for recording data to the voice data section 10B of the semiconductor memory section 10 (step ST13).

If the operated button is not the recording button REC, the detection of the play button PL is performed (step ST14). If the play button PL is pressed, the memory control circuit 7 is controlled, and recorded data is read from the voice data section 10B of the semiconductor memory section 10 to be sent to the DSP5, in which the expansion processing is performed. The expand voice data is sent to the D/A converter 11, so that the reproduction processing is performed (step ST15).

If the play button PL is not pressed, the state of the forward feeding button FF is detected to check whether or not the forward feeding button is pressed (step ST16). If the forward feeding button FF is pressed, the forward feeding processing in which the operational position is sequentially fed at a suitable speed (e.g., twenty times as fast as playing speed) is performed (step ST17).

If the feeding button FF is not pressed, the state of the rewinding button REW is detected to check whether or not the rewinding button REW is pressed (step ST18). If the rewinding button REW is pressed, the rewinding processing in which the operational position is moved at the same speed as the case of the forward feeding is performed (step ST19).

Each of steps ST13, ST15, ST17, ST19 is returned to step ST11 if the stop button ST is pressed.

If the operated button is not the recording button, play button, forward feeding button, or rewinding button, it is detected whether or not the main power switch 19 is turned off. Or, the state of each of the various kinds of setting buttons is detected (step ST20).

When the main power switch 19 is turned off, the memory controlling circuit 7 is controlled to transfer index data stored in the memory section (not shown) of the main controlling circuit 6 to the index section 10A of the semiconductor memory section 10 to be recorded thereto in order to renew data of the index section 10A of the semiconductor memory section 10 (step ST21). If the index transferring processing is completed, the power switch supplied to the entire apparatus is turned off (step ST22).

If it is checked that the main power switch 19 is not turned off in the step ST20, the states of various setting buttons are detected to be recorded to the interior of the recording section. Thereafter, the operation is returned to step ST11. In this case, the setting buttons are not the buttons, which are actually provided in the apparatus. The setting buttons means that some of buttons, that is, recording buttons REC, play button PL, step button ST, forward feeding button FF, rewinding REW, I mark button I, E mark button E, and voice activation (voiceless compression) button VAD are simultaneously pressed.

Figure 6:
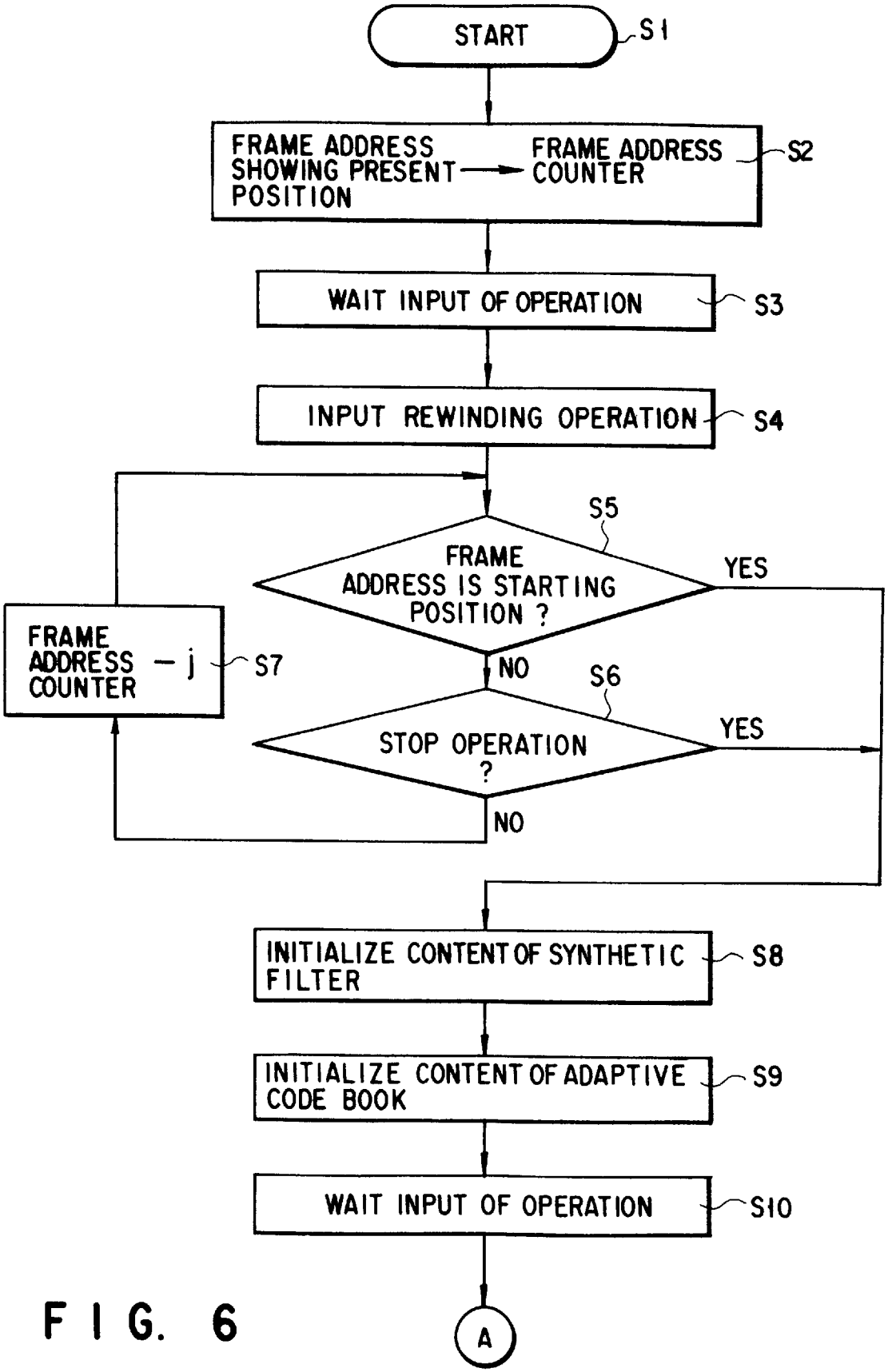
FIG. 6 shows a first part of a flow chart for explaining an operation of a main controlling circuit of a first embodiment of the present invention.
Figure 7:
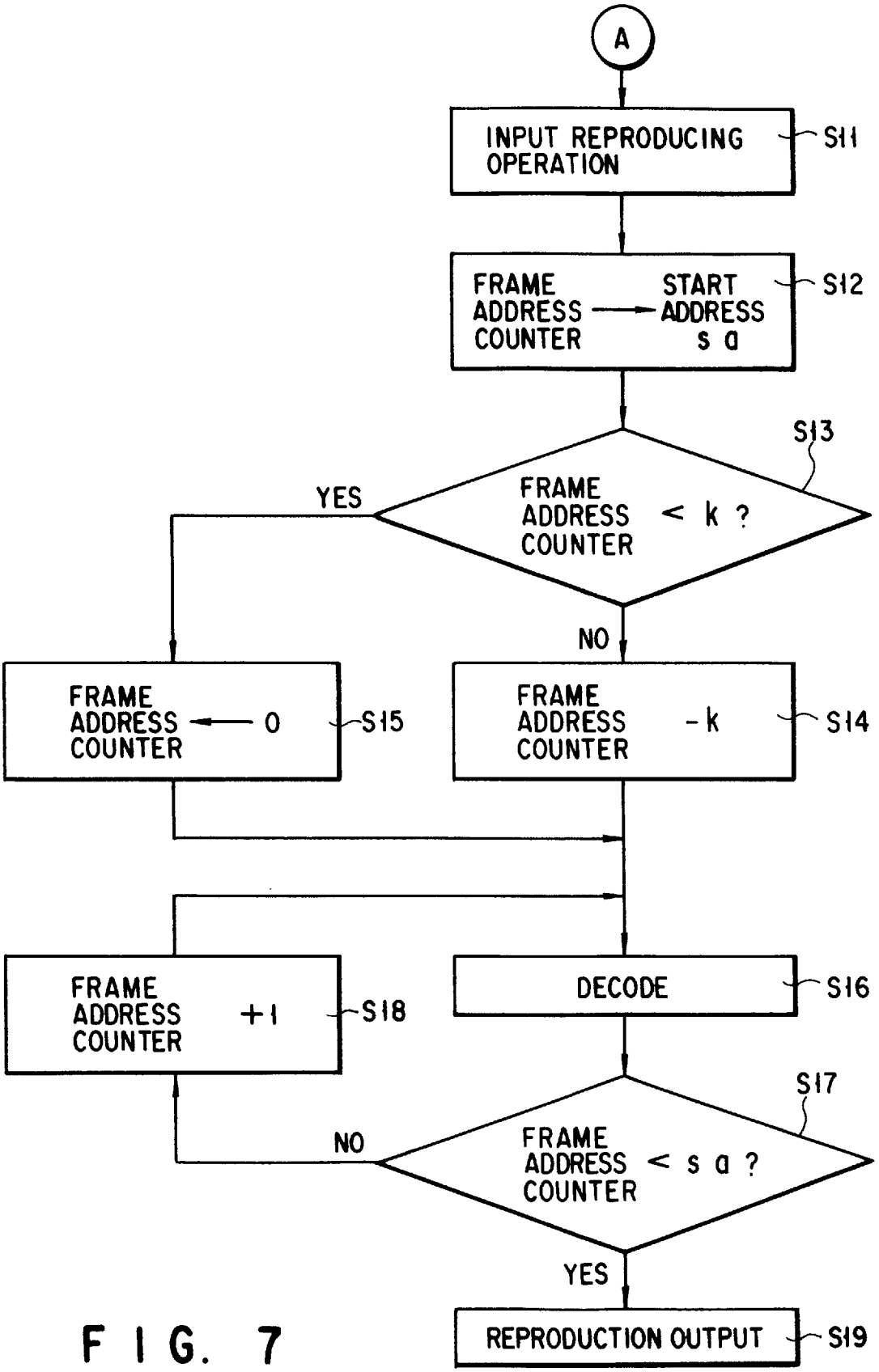
FIG. 7 shows a second part of a flow chart for explaining an operation of a main controlling circuit of a first embodiment of the present invention.

The following will explain an operation of the main controlling circuit 6 of the first embodiment of the present invention with reference to FIGS. 6 and 7.

The flow charts of FIGS. 6 and 7 show the operations of the main controlling circuit 6 which are performed when the user presses the rewinding button REW to perform the rewinding operation and stops the operation at an arbitrary time, and performs the reproducing operation. In the figures, step S1 shows the state after the power supply and the end of the stop operation. In step S2, the main controlling circuit 6 sets the frame address showing the present position to the frame address counter 30 based on the using state of the semiconductor memory section 10. Thereby, in step S3, the next input of the operation is set to be in a standby state. Then, the user presses the rewinding button REW (step S4), so that the the rewinding operation is started in steps S5 to S7.

More specifically, in step S5, it is checked whether or not the frame address is equal to the address showing the starting position of voice data. In step S6, it is checked whether or not the user performs the stop operation. If NO in steps S5 and S6, the operation goes to step S7. In step S7, the value of the frame address counter 30 is reduced by a predetermined value j (e.g., 10), and the operation of step S5 is executed again. In this way, until the frame address reaches the starting position of voice data or the stop operation is executed, the value of the frame address counter 30 is reduced, and the rewinding operation is repeated.

On the other hand, if YES in steps S5 and S6, the content (internal state) of at least one of the synthetic filter 146 of FIG. 4 and the adaptive code book 141 is initialized (cleared) in steps S8 and S9. At this time, the value of the frame address counter 30 is maintained so that the operation input is set to be in a standby state (step S10). By executing these steps S8 and S9, deterioration of voice quality such as generation of an undesired voice due to influence of the voice source signal obtained just before the rewinding operation is executed can be prevented. In this way, the main controlling circuit 6 functions as initializing means for initializing the contents of the synthetic filter 146 and the adaptive code book 141. In this case, initialization means the writing operation for writing "0" to the synthetic filter 146 and the adaptive code book 141.

In step S11, if the user presses the play button PL, the value of the present frame address counter 30 is stored as a start address as (step S12). In step S13, it is checked whether or not the value of the present frame address counter 30 is smaller than a predetermined value k (e.g., 5). If NO, the operation goes to step S14, and the value of the frame address counter 30 is reduced by k. If YES, the value of the frame address counter 30 is set to "0." Thereafter, voice data of the address shown by the frame address counter 30 is decoded (step S16). In step S17, it is checked whether or not the value of the present frame address counter 30 is equal to the start address as. If NO, the operation goes to step S18, and the value of the frame address counter 30 is increased by +1 and step S16 is executed again. In this way, until the value of the frame address counter 30 is equal to the start address as, the value of the frame address counter 30 is increased by +1, and the decoding processing is repeated. However, at this time, decoded data is not inputted to the D/A converter 11.

If YES in step S17, the above-mentioned reproduction output operation is executed (step S19). In this way, the main controlling circuit 6 functions as controlling means for controlling the decoding operation according to where reproduction starts. That is, if the reproduction starts from the midway point of the recorded data, the main controlling circuit 6 controls the decoding operation to be started from the reproducing position, which is returned by predetermined time (a predetermined number of frames).

As mentioned above, according to the digital data recording/reproducing apparatus of the first embodiment of the present invention, the decoding is started from the frame, which is returned by the predetermined number of frames from the frame corresponding to the predetermined reproduction output point. Therefore, the content of the adaptive code book 141 can be recovered to follow the voice corresponding to the predetermined reproduction output point, and the voice signal can be reproduced well.

In the above-mentioned embodiment, the predetermined value k, which designates the decoding starting point, was set to 5. The above is the value obtained by confirming that at least about 100 ms, that is, about five frames, is needed to recover the state in which the content of the adaptive code book 141 can follow the voice of the predetermined production output point.

Moreover, the above embodiment explained the case where the reproducing operation was executed after the user executed the rewinding operation and stopped the operation. However, the above embodiment can be applied to the case in which the reproduction is arbitrarily started in midway point of the production output point by the forward feeding or the other operations.

Figure 8:
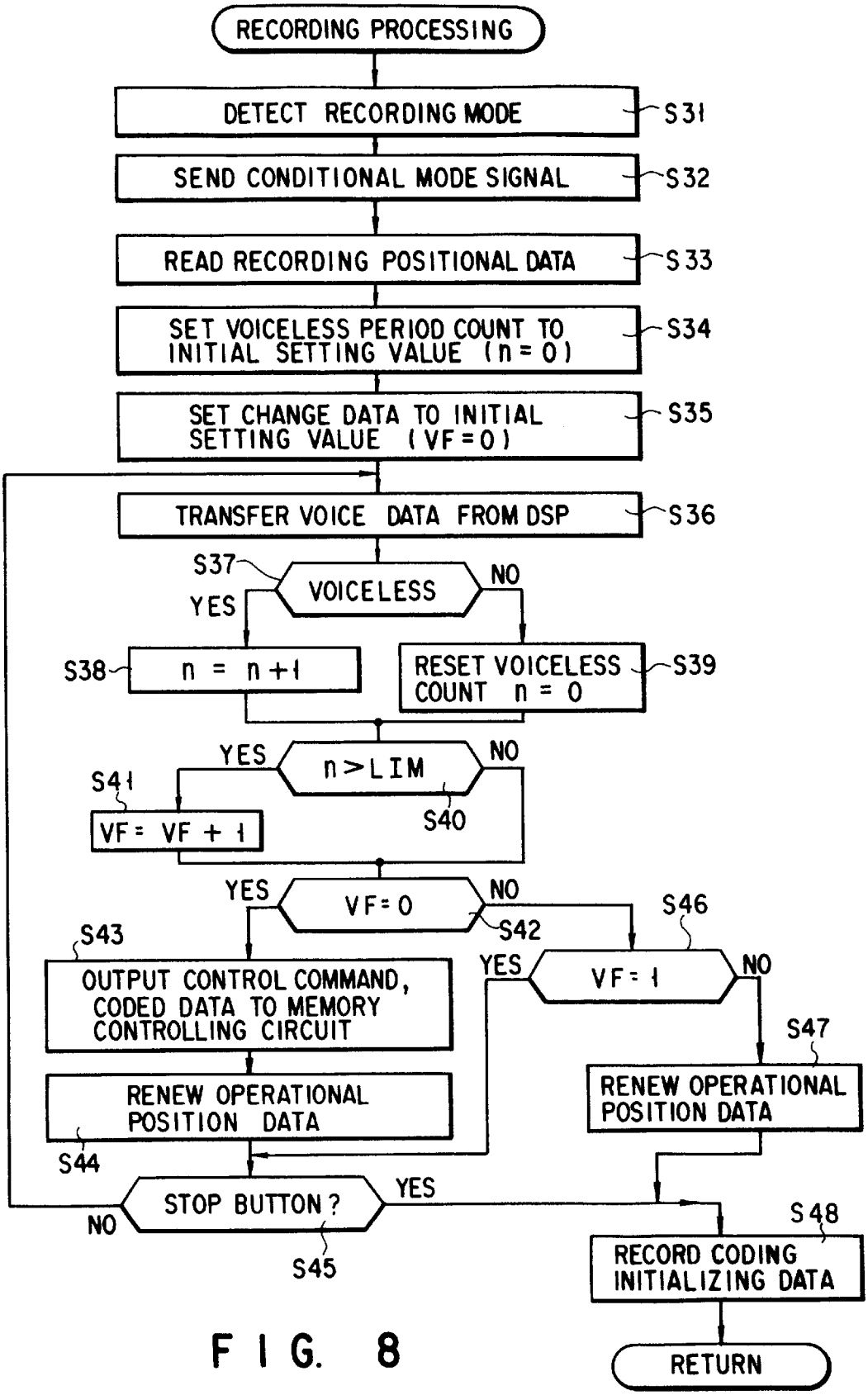
FIG. 8 is a flow chart for explaining an operation of a main controlling circuit at the time of recording in a second embodiment of the present invention.

The following will explain an operation of the main controlling circuit of a second embodiment of the present invention when recording is executed with reference to the flow chart of FIG. 8.

If the controlling circuit 6 detects that the recording button REC is pressed and the recording mode is set (step S31), the operation goes to the recording processing. At this time, the recording conditions (for example, voice activation, voiceless compression, or the adaptive variable of the voice compression rate) are detected. As an operational condition, the condition in which the voice activation and the voiceless compression are not executed is set. The signal showing the detected recording condition is sent to DSP 5 as a conditional mode signal (step S32). Then, in the index section 10A of the semiconductor memory section 10, there are recorded a head address position data 10A1 of next voice file data, size data 10A2 of voice file data, file erasing flag data 10A3, a recording file number 10A4, identification data 10A5 of a voice coding system, flag data 10A6 showing a file state, a maximum number (n) of files, which can be edited (inserted) 10A7, and length data 10A8 up to inserted voice data. In addition, starting position address data at the time of editing, head address position data of file data, and file size data are recorded to the index section 10A of the semiconductor memory section 10 in order, starting from starting position address data 10A9 of the first editing, head address position data 10A10 of file data of the first editing, file size data 10A11 of the first editing to starting position address data 10A12 of the maximum inserting nth editing, head address position data 10A13 of file data of the maximum inserting nth editing, file size data 10A14 of the maximum inserting nth editing.

In the voice data section 10B, there are recorded voice coding data including first frame data 10B1, second frame data 10B2, third frame data 10B3 . . . mth frame data 10Bm in order.

Then, memory management address data (recording position data) stored in the internal recording section of the main controlling circuit 6 is read (step S33). Then, a count value n of voiceless time for measuring voiceless time is set to an initial setting value 0 (step S34). Next, a value VF showing data for changing the apparatus is set to an initial setting value 0 (step S35). Next, voice data, which is compress-coded in the DSP5, is transferred to the semiconductor memory section 10 from the main controlling circuit 6 (step S36). As DSP5 of this embodiment, there is used a voice coding system of an analyze-synthesizing type such as a code excited linear predictive coding for vector-quantizing an excitation (residual) signal using the code book. The voice coding of the CELP type deals with the inputted voice signal in predetermined time (e.g., 20 msec) as one frame (for example, data of one frame having 160 data when a sample frequency is 8 KHz), and the following parameters are obtained by use of voice data of one frame.

More specifically, first, a linear predictive coefficient (LPC) (short-term predictive filter coefficient or reflective coefficient) is calculated, quantized, and outputted. Then, the degree of similarity of excited (residual) signal models (code books) of some voice source data are checked to find out the model having the highest degree of similarity. At this time, the numbers (index) of the excited (residual) signal models of voice source data and gain data are quantized and coded.

In the process of coding, it is checked whether or not voice data of one frame is voiceless (step S37). The following method is used as a method for detecting whether or not voice data of one frame is voiceless.

More specifically, DSP 5 calculates the cross correlation among energy (total of the square of each sample data) of voice data of one frame or the maximum value of one frame, and the voice signal, and the residual signal to detect whether or not data is voiceless. Then, voiceless data is coded to 0, and vocal data is coded to 1 to be output. The main controlling circuit 6 detects whether or not data is voiceless based on data transferred from the DSP 5.

Then, if the detection result is voiceless data, one is added to the voiceless period count value n to increase the count (step S38). If the detection result is not voiceless data, the voiceless period count value n is reset to the initial setting value 0 (step S39). Then, in order to detect whether or not voiceless data exceeds a predetermined value or more, it is detected whether or not the voiceless data period count value n is more than e.g., limit value LIM=500 (this means that voiceless data of 500 frames is continued. In this case, voiceless data is continued for 10 seconds) (step S40). The value LIM ranges from 5 to 65535, preferably about 100 to 3000, particularly about 150 to 500. In this embodiment, LIM=500 is used.

Then, if the limit value LIM is more than 500, one is added to the change data value VF (step S41). When the change data value VF is 0, the operation is changed to the initial state. When the change data value VF is 1, the operation is changed to the voice activation (voiceless compression) mode. When the change data value VF is 2 or more, the operation is changed to the stop state. In the case where the voiceless state is continuously generated, the limit value LIM can be varied in accordance with the frequency of the generation. For example, when the change data value VF is 0, the limit value LIM is set to 500. When the the change data value VF is 1, the limit value LIM is set to 50. In this way, the limit value LIM can be differently set in accordance with the situation so as to execute the operation, which is automatically changed to the recording mode in which the recording medium is efficiently used in a case where there are included many voiceless states in the speaker's talk (for example, a case of recording the speaker's talk as considering).

Next, it is checked whether or not the change data value VF is 0 (step S42). If the change data value VF is 0, voice coded data transferred from DSP 5 is outputted to the memory controlling circuit 7 together with a control command (step S43). Then, coded data is recorded to the semiconductor memory section 10 by the memory controlling circuit 7. Next, operational position data stored in the internal storing section of the main controlling circuit 6 is renewed (step S44). The values to be renewed are head address position data 10A1 of next voice file data of the index section 10A and the size 10A2 of voice file data.

Then, it is detected whether or not the stop button ST is pressed (step S45). If the stop button ST is not pressed, the operation is returned to the step S36, and the above operation is repeated. Also, if the stop button ST is pressed, operational position data stored in the internal storing section of the main controlling circuit 6 is recorded in the index section 10A, and coding initializing data C="1", which is used to initialize the content of the adaptive code book 141 at the time of reproducing, is recorded to the voice data section 10B (FIG. 2) of the finally coded frame (step S48). Then, the recording processing is terminated. In this way, the main controlling circuit 6 functions as recording means for recording coding initializing data C="1."

Also, if it is detected that the change data value VF is not 0 in step S42, and that the change data value VF is 1 in step S46, the operation goes to step S45. If it is detected that the change data value VF is not 1 in step S46, operational position data stored in the internal storing section of the main controlling circuit 6 is renewed (step S47). Then, operational position data stored in the internal storing section is recorded in the index section 10A. Thereafter, the operation goes to step S48, and coding initializing data C="1", which is used to initialize the content of the adaptive code book 141 at the time of reproducing, is recorded to the voice data section 10B (FIG. 2) of the finally coded frame. Then, the recording processing is terminated.

Figure 9:
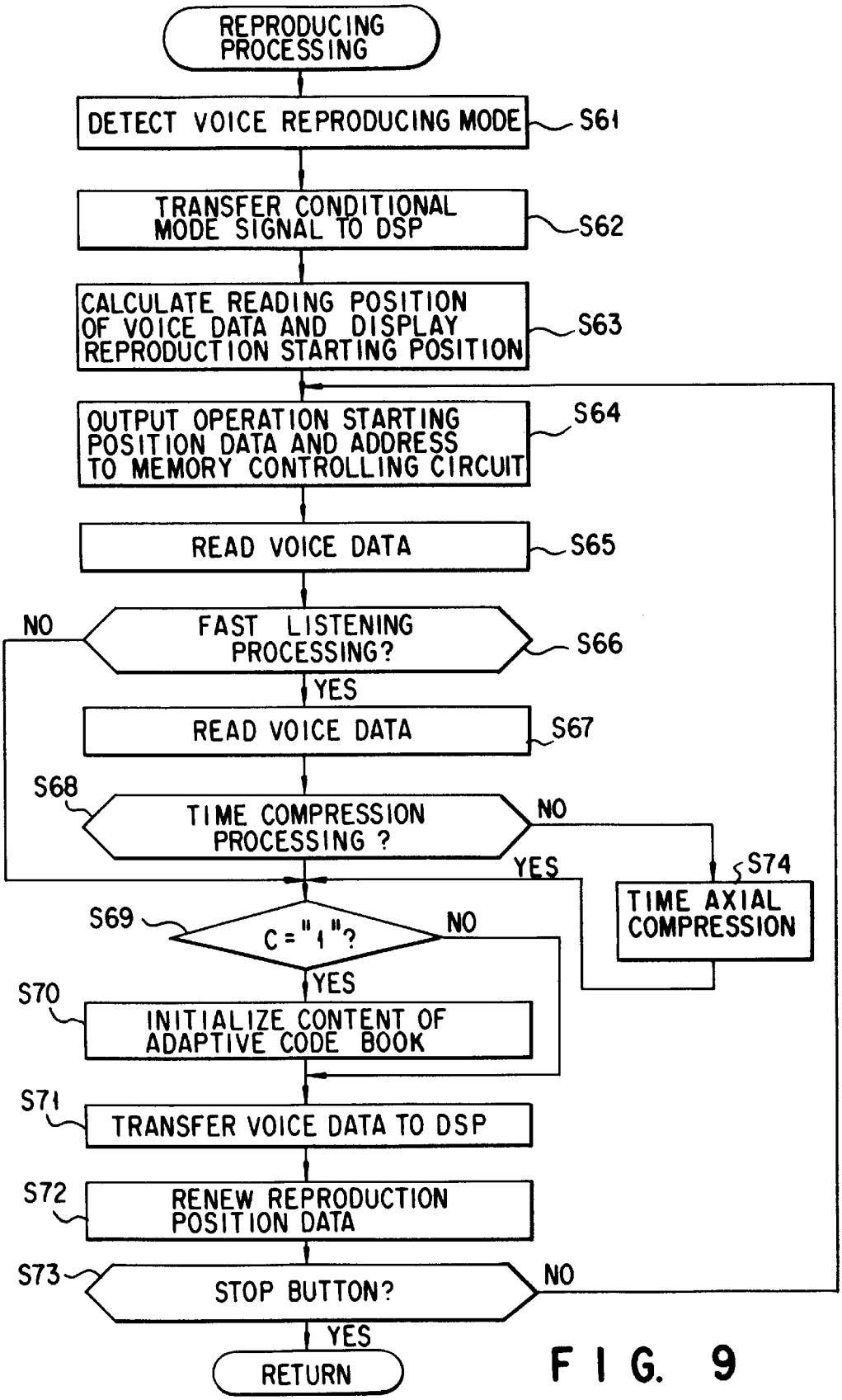
FIG. 9 is a flow chart for explaining an operation of a main controlling circuit at the time of reproducing in the second embodiment of the present invention.

The following will explain the details of the reproduction processing in step S15 of FIG. 5 with reference to the flow chart of FIG. 9.

First of all, if it is detected that the playing button PL is pressed in step S61, the operation goes to the sub-routine of the reproduction processing (detection of the voice reproduction mode). At this time, the main controlling circuit 6 detects the conditions of the voice reproduction conditions (voiceless compression, speed reproduction, noise removal), and resets the internal counter for counting the number of reading blocks. Then, the main controlling circuit 6 sends the signal showing the condition mode of the voice reproduction to DSP 5 based on the detected conditions (step S62).

Thereafter, the reading position of voice data, which is stored in the internal storing section of the main controlling circuit 6, is calculated to obtain operational position data of the index data section 10A. Then, the driving circuit 9 is controlled to display operational position data, serving as a reproduction starting position, on the display 8 (step S63). Then, in order to read the voice message file from the voice data section 10B of the semiconductor memory section 10, operational start position data, which is stored in the internal storing section, and the address, which is calculated from the index data section 10A, are outputted to the memory controlling circuit 7 (step S64). Thereby, voice data of one block (data in which the voice is divided to the block of 20 ms) is read to the main controlling circuit 6 (step S65).

Here, it is checked whether or not a fast listening processing is executed by detecting the mode, which is set according to the state of the voice activation button VAD (step S66). Then, for executing the fast listening processing, voice data of one more block is read to the main controlling circuit 6 from the semiconductor memory section 10 (step S67). Then, it is detected whether or not the time compression processing is executed (step S68). If the mode is not the mode in which the time compression processing is executed, the operation goes to step S69. If the mode is the mode in which the time compression processing is executed, a command for executing a time axial compression is outputted to the DSP 5 to execute the time axial compression (step S74). Thereafter, the operation goes to step S69.

In step S69, it is detected whether or not coding initializing data C of the voice data section 10B of FIG. 2 is "1". If C=1, the content (internal state) of the adaptive code book 141 is initialized (step S70). Then, voice data of one frame is transferred to the DSP 5 (step S71). In this way, the main controlling circuit 6 functions as initializing means for initializing the content of the adaptive code book 141. In this case, initializing the content of the adaptive code book 141 means writing "0" to the adaptive code book 141.

Then, the main controlling circuit 6 calculates the position (operational position) of next voice data to be reproduced based on data of the index data section 10A and reproducing positional data stored in the internal storing section, and renews reproducing positional data stored in the internal storing section (step S72). Thereafter, it is detected whether or not the stop button ST is pressed (step S73). If the stop button is pressed, the reproduction processing is not executed. If the stop button is not pressed, the operation goes back to the step S64 and the reproduction processing is continued.

In the above-mentioned second embodiment, when the stop button ST is pressed and the recording is stopped, coding initializing data C="1" is recorded. However, C="1" may be recorded in a case where the editing operation such as an insert recording and a partially cutting of the voice is performed.

According to the second embodiment, the coding initializing data C=1 is recorded together with the coded voice data to the voice data section 10B of the semiconductor memory section 10 when the stop of recording or the editing operation are executed. Since the content of the adaptive code book 141 is initialized based on the state of coding initializing data C at the time of reproduction, the voice having a good quality can be reproduced without generating an undesired sound during the reproduction of the voice.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A voice recording/reproducing apparatus for coding and decoding voice data in units of one frame, said apparatus comprising:

voice source signal-producing means for producing a voice source signal using an adaptive code book produced based on past voice source signals;

linear prediction analyzing means for performing a linear prediction analysis on the voice signal source signal to thereby obtain a linear prediction parameter;

synthesizing means for producing a synthetic signal based on the linear prediction parameter and the voice source signal; and initializing means for initializing at least one of an internal state of the adaptive code book of the voice source signal-producing means and an internal state of the synthesizing means, before reproducing voice data at a desired reproducing position after a series of voice data frames have been reproduced, said desired reproducing position differing from a reproducing position corresponding to a last-reproduced frame.

2. A voice recording/reproducing apparatus for coding and decoding voice data in units of one frame, said apparatus comprising:

voice source signal-producing means for producing a voice source signal using an adaptive code book produced based on past voice source signals;

linear prediction analyzing means for performing a linear prediction analysis on the voice signal source signal to thereby obtain a linear prediction parameter;

synthesizing means for producing a synthetic signal based on the linear prediction parameter and the voice source signal; and controlling means for controlling a start of decoding of a coded voice data frame which precedes, by a predetermined is frame, a frame corresponding to a desired reproducing position when voice data is reproduced at the desired reproducing position after a series of voice data frames have been reproduced, said desired reproducing position differing from a reproducing position corresponding to a last-reproduced frame.

3. The apparatus according to claim 2, wherein an internal state of the adaptive code book is recovered within a time period up to a state in which a normal reproduction signal is obtained at the desired reproducing position, said time period being a time period for which reproducing is performed from the coded voice data frame to the frame corresponding to the desired reproducing position.

4. The apparatus according to claim 2, wherein a reproduction output of the voice data starts from the desired reproducing position.

5. A voice recording/reproducing apparatus for coding and decoding voice data in units of one frame, said apparatus comprising:

voice source signal-producing means for producing a voice source signal using an adaptive code book produced based on past voice source signals;

linear prediction analyzing means for performing a linear prediction analysis on the voice signal source signal to thereby obtain a linear prediction parameter;

synthesizing means for producing a synthetic signal based on the linear prediction parameter and the voice source signal;

index information recording means for recording, on a recording medium, index information indicating a boundary portion of voice data which is located between two series of voice data pieces of the voice data; and initializing means for initializing, when the index information is detected at a time of voice reproduction, at least one of an internal state of the adaptive code book of the voice source signal-producing means and an internal state of the synthesizing means, before reproducing successive voice data from the boundary portion.

6. The apparatus according to claim 5, wherein the boundary portion corresponds to a position in which a recording operation is stopped at a time of voice recording.

7. A voice reproducing apparatus for reproducing coded voice data in units of one frame, said apparatus comprising:

an adaptive code book produced using past voice source signals;

decoding means for decoding voice data using said adaptive code book; and initializing means for initializing an internal state of the adaptive code book, before reproducing voice data at a desired reproducing position after a series of voice data frames have been reproduced, said desired reproducing position differing from a reproducing position corresponding to a last-reproduced frame.

8. A voice reproducing apparatus for reproducing coded voice data in units of one frame, said apparatus comprising:

an adaptive code book produced using past voice source signals;

decoding means for decoding voice data using said adaptive code book; and controlling means for controlling a start of decoding of a coded voice data frame which precedes, by a predetermined frame, a frame corresponding to a desired reproducing position when voice data is reproduced at the desired reproducing position after a series of voice data frames have been reproduced, said desired reproducing position differing from a reproducing position corresponding to a last-reproduced frame.

9. The apparatus according to claim 8, wherein an internal state of the adaptive code book is recovered within a time period up to a state in which a normal reproduction signal is obtained at the desired reproducing position, said time period being a time period for which voice data frames are reproduced from the coded voice data frame to the frame corresponding to the desired reproducing position.

10. The apparatus according to claim 8, wherein the reproduction output of the voice data starts from the desired reproducing position.

11. A voice reproducing apparatus for reproducing coded voice data in units of one frame, said apparatus comprising:

an adaptive code book produced using past voice source signals;

decoding means for decoding voice data using the adaptive code book;

index information recording means for recording, on a recording medium, index information indicating a boundary portion of the voice data which is located between two series of voice data pieces of the voice data; and initializing means for initializing, when the index information is detected at a time of voice reproduction, an internal state of the adaptive code book, before reproducing successive voice data from the boundary portion.

* * * * *